US007372201B1

(12) United States Patent
Roberts

(10) Patent No.: US 7,372,201 B1
(45) Date of Patent: May 13, 2008

(54) SUB-MINIATURE ARC LAMP

(75) Inventor: Roy D. Roberts, Hayward, CA (US)

(73) Assignee: Vaconics Lighting, Inc., Sunnyvale, CA (US)

( * ) Notice: Subject to any disclaimer, the term of this patent is extended or adjusted under 35 U.S.C. 154(b) by 169 days.

(21) Appl. No.: 10/732,792

(22) Filed: Dec. 9, 2003

(51) Int. Cl.
*H01J 17/22* (2006.01)

(52) U.S. Cl. ..... 313/558; 313/562

(58) Field of Classification Search ..... 313/549, 313/553–562, 545, 547; 252/181.1–181.7
See application file for complete search history.

(56) References Cited

U.S. PATENT DOCUMENTS 2,322,421 A * 6/1943 Cox ..... 313/318.12
3,728,004 A * 4/1973 Waymouth ..... 445/40
3,778,662 A * 12/1973 Johnson ..... 313/490
4,034,252 A * 7/1977 McVey ..... 313/625
4,107,565 A * 8/1978 Isojima et al. ..... 313/565
4,195,745 A 4/1980 Roberts et al.
4,599,540 A 7/1986 Roberts
4,633,128 A * 12/1986 Roberts et al. ..... 313/113
4,658,179 A 4/1987 Roberts
4,702,716 A 10/1987 Roberts
4,724,352 A 2/1988 Schuda et al.
4,785,216 A 11/1988 Roberts et al.
4,823,043 A 4/1989 Roberts et al.
4,940,922 A 7/1990 Schuda et al.
4,990,828 A * 2/1991 Rabusin ..... 313/546
5,299,279 A 3/1994 Roberts
5,399,931 A 3/1995 Roberts
5,418,420 A 5/1995 Roberts
5,561,338 A 10/1996 Roberts et al.
5,672,931 A 9/1997 Kiss et al.
5,721,465 A 2/1998 Roberts
5,856,726 A * 1/1999 Evans et al. ..... 313/491
5,903,088 A * 5/1999 Sugitani et al. ..... 313/46
6,034,467 A 3/2000 Roberts
6,099,375 A * 8/2000 della Porta ..... 445/9
6,181,053 B1 1/2001 Roberts
6,200,005 B1 3/2001 Roberts et al.
6,285,131 B1 9/2001 Kiss et al.
6,297,591 B1 10/2001 Roberts
6,316,867 B1 11/2001 Roberts et al.
6,351,058 B1 2/2002 Roberts
6,597,087 B2 7/2003 Roberts et al.
6,602,104 B1 8/2003 Roberts

OTHER PUBLICATIONS

Monch, "Optimised Light Sources for Projection Displays", Philips Research Laboratories, Aachen, Germany, 4 pages.
Saes Getters, "Lamp Lifetime", Miniature Mercury Dispensers, 5 pages.

* cited by examiner

*Primary Examiner*—Joseph Williams
*Assistant Examiner*—Christopher M. Raabe
(74) *Attorney, Agent, or Firm*—Blakely, Sokoloff, Taylor & Zafman LLP

(57) ABSTRACT

The disclosure has described a sub-miniature arc lamp and a method to make a sub-miniature arc lamp. An embodiment of the sub-miniature arc lamp includes a sapphire body having a first end and a second end, the first end being coupled to a first cap and the second end being coupled to a second cap to define a sealed envelope, wherein a first electrode being mounted in the first cap and a second electrode being mounted in the second cap are enclosed within the envelope. Other embodiments are described and claimed.

16 Claims, 5 Drawing Sheets

SUB-MINIATURE ARC LAMP

FIELD OF INVENTION

The present invention relates to arc lamps, and more particularly, to sub-miniature arc lamps.

BACKGROUND

In optical systems involving the generation and controlled radiation of long or continuous pulses of light, such as spectroscopy, or solar simulation, where high intensity, color correct illumination of sensitive working areas is required, such as in fiber optics illumination devices, it is advantageous to have a light source capable of producing the highest possible light flux density. Products utilized in such applications include short arc inert gas lamps. An existing short arc lamp includes a sealed quartz chamber containing a gas pressurized to several atmospheres, and an opposed anode and cathode defining an arc gap. A window provides for the transmission of the generated light, and a reflector may be positioned surrounding the arc gap.

Various applications require small short arc lamps, such as in video projectors and medical and dental equipments. Sub-miniature arc lamps are produced to meet the needs of these applications. In an existing design of a sub-miniature arc lamp, an anode and a cathode are mounted inside a quartz tube with a top and a base. The anode and the cathode are separated by a short arc gap. The joint between the quartz tube and the top and the joint between the tube and the base are sealed. The quartz tube is filled with inert gas. During operation, the breakdown voltage is exceeded across the short arc gap between the anode and the cathode, an illuminating flow of electrons is discharged from the cathode to the anode.

Generally speaking, there are four major reasons for lamp failure, including electrode erosion, contamination of the fill gas, cracked glass to metal seals, and explosion caused by devitrification or cracking of the quartz tube. Erosion of the electrodes causes a reduction in light output and, potentially, failure of the quartz tube. Devitrification of the quartz tube, caused by the high temperature inside the quartz tube during operation, is the removal or destruction of the glassy quality of the quartz tube. In addition to devitrification, the high temperature inside the quartz tube can also lead to the cracking of the quartz tube. Eventually, the devitrification and cracking of the quartz tube will lead to breakage of the quartz tube. Besides damaging the lamp, breakage of the quartz tube can cause user injuries as well.

Moreover, high peak currents discharged through the lamp during operation generate instantaneous high temperature on the inner wall of the quartz tube. The high temperature on the inner wall of the quartz tube causes the silicon oxide in the quartz tube to reduce to silicon and oxygen, which causes contamination of the fill gas. In addition to high temperature, devitrification will also lead to oxygen generation from the quartz tube. The electronegative nature of the oxygen inhibits the electron flow and effectively raises the breakdown voltage of the lamp. An increased breakdown voltage impedes ignition and triggers reliability problems with the lamp.

A prior solution to reduce the contamination inside the quartz tube is to use gas additives to reduce tungsten wall coverage inside the quartz tube. However, the gas additives also make processing the sub-miniature arc lamps at high temperature difficult.

Another prior solution is to operate the lamp in a vertical position to minimize devitrification of the quartz tube. Horizontal operation in high pressure quartz lamps tends to cause early failures due to tube devitrification problems. However, having to operate the arc lamp in vertical orientation complicates the design of the optical equipment using the arc lamp.

SUMMARY

A sub-miniature arc lamp and a method to make a sub-miniature arc lamp are described. An embodiment of the sub-miniature arc lamp includes a sapphire body having a first end and a second end, the first end being coupled to a first cap and the second end being coupled to a second cap to define a sealed envelope, wherein a first electrode being mounted in the first cap and a second electrode being mounted in the second cap are enclosed within the envelope. Other features of the present invention will be apparent from the accompanying drawings and from the detailed description that follows.

BRIEF DESCRIPTION OF THE DRAWINGS

The present invention will be understood more fully from the detailed description that follows and from the accompanying drawings, which however, should not be taken to limit the appended claims to the specific embodiments shown, but are for explanation and understanding only.

DETAILED DESCRIPTION

In the following description, numerous specific details are set forth. However, it is understood that embodiments of the invention may be practiced without these specific details. In other instances, well-known components, structures, and techniques have not been shown in detail in order not to obscure the understanding of this description.

Figure 1C:
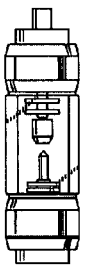
FIG. 1C shows a full size view of an embodiment of a mercury xenon 150 Watt lamp.
Figure 1B:
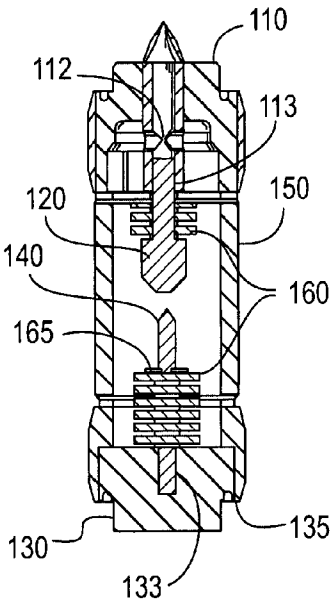
FIG. 1B shows a cross-section view of the embodiment of the sub-miniature arc lamp along the axis A as shown in FIG. 1A.
Figure 1B:
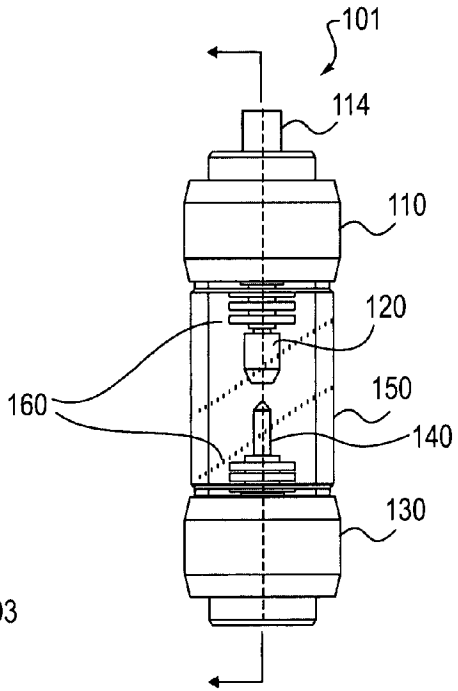
Figure 1A:
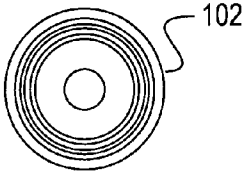
FIG. 1A shows a side view, a top view 102, and a bottom view 103 of an embodiment of a sub-miniature arc lamp.
Figure 1A:
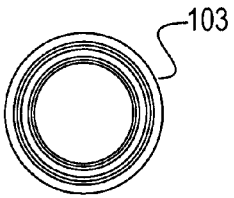

FIG. 1A shows a side view 101, atop view 102, and a bottom view 103 of an embodiment of a sub-miniature arc lamp. The embodiment includes a sapphire tube 150, a first cap on top of the sapphire tube 150 (also referred to as a top) 110, a tubulation 114, an anode 120, a second cap on the base of the sapphire tube 150 (also referred to as a base) 130, a cathode 140, and a number of getters 160. The tubulation 114 is inserted into the top 110. The anode 120 is mounted in the top 110 through the tubulation 114. The cathode 140 is mounted in the base 130. The top 110 and the base 130 are attached to the top and bottom of the sapphire tube 150 respectively to form a sealed envelope. The sealed envelope inside the sapphire tube is filled with an inert gas. Replacing the quartz tube with a sapphire tube reduces devitrification of the tube during operation, and hence, helps to prolong lamp life. Moreover, using a sapphire tube also reduces contamination of the inert gas inside the sapphire tube because, unlike the quartz tube, the inner wall of the sapphire tube does not release oxygen during operation at high temperature. It should be apparent to one of ordinary skill in the art that sapphire bodies of other shapes, such as a sphere, can be used to build a sub-miniature arc lamp. The sapphire tube in FIG. 1A is used only for illustrative purposes, and should not be construed to limit the scope of the appended claims.

Furthermore, a number of getters are mounted along the anode 120 and the cathode 140 to absorb or remove impurities inside the sapphire tube. Along the cathode 140, a retainer ring 165 is put on top of the getters 160 to hold the getters in place along the cathode. In one embodiment, the getters include one or more mercury ("Hg") dispensing getters. The mercury-dispensing getters, made from a mixture of titanium mercury alloys marketed by SAES GETTERS S.p.A. in Milano, Italy under the trade names St 505® and St 101®, are non-evaporable. The alloy mixture can be compressed into various shapes, such as, pills, rings, pellet strips, or slotted strips. The combination of alloys dispenses a controlled quantity of mercury and absorbs the impurities within the inert gas inside the sealed sapphire tube. In an alternate embodiment, the getters are mounted along only the cathode. In another embodiment, the getters are mounted along only the anode.

FIG. 1B shows the cross-section view of the embodiment of the sub-miniature arc lamp along axis A in FIG. 1A. The embodiment includes a top 110, a tubulation 114, an anode 120, a base 130, a cathode 140, a sapphire tube 150, and a number of getters 160. The tubulation 114 is inserted into the top 110. The anode 120 is pressed into the top 110 at 113 through the tubulation 114, i.e. the anode 120 is coupled to the top 110 by press fit. Similarly, the cathode 140 is press-fitted in the base 130 at 133. However, it should be apparent to one of ordinary skill in the art that other mounting techniques can be used to mount the anode to the top and to mount the cathode to the base. The base 130 is attached to the bottom of the sapphire tube 150 at the welded ends 135. The top 110 is attached to the top of the sapphire tube 150 to form a sealed envelope. The sealed envelope inside the sapphire tube is filled with an inert gas via the gas entry hole 112 in the top 110. The embodiment further includes a set of getters 160 mounted along the anode and the cathode.

During operation of the lamp, the sealed envelope of the sapphire tube 150 is filled with an inert gas at a pressure of several atmospheres. In one embodiment, the envelope is filled with xenon. When the breakdown voltage is exceeded across the short arc gap between the anode 120 and the cathode 140, an illuminating flow of electrons is discharged from the cathode 140 to the anode 120.

FIG. 1C shows a full size view of an embodiment of a mercury xenon 150 Watt lamp. The lamp shown in FIG. 1C has a height of 1.43 inches and a diameter of 0.46 inches. It should be understood that the embodiment shown in FIG. 1C is for illustrative purpose only. Other embodiments of a mercury xenon lamp can have different dimensions and power.

Figure 2:
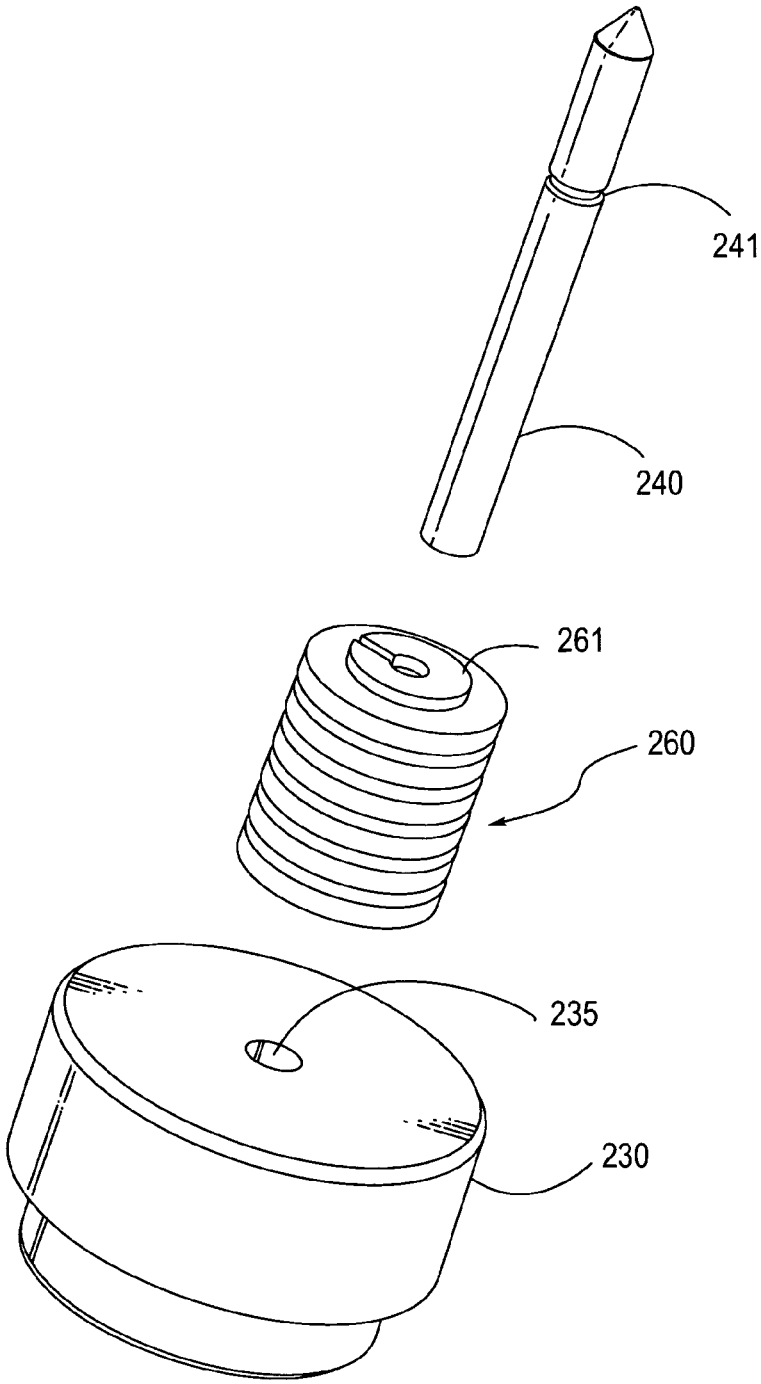
FIG. 2 shows an embodiment of a cathode assembly.

FIG. 2 shows an embodiment of a base and cathode assembly of a sub-miniature arc lamp. The assembly includes a base 230, a number of mercury dispensing getters 260, a number of spacers 261, and a cathode 240. On the cathode 240, there is a ridge 241 near the top of the cathode 240 to accommodate a retaining ring (not shown). The retaining ring holds the getters 260 in place when the getters 260 are mounted along the cathode 240. The components in FIG. 2 are shown separated from each other in order to provide the reader with an unobstructed view of every component. In practice, the getters 260 are mounted along the cathode 240, and the lower end of the cathode 240 is pressed into the hole 235 in the middle of the base 230. Each of the spacers 261 is mounted along the cathode in between two getters.

Figure 3:
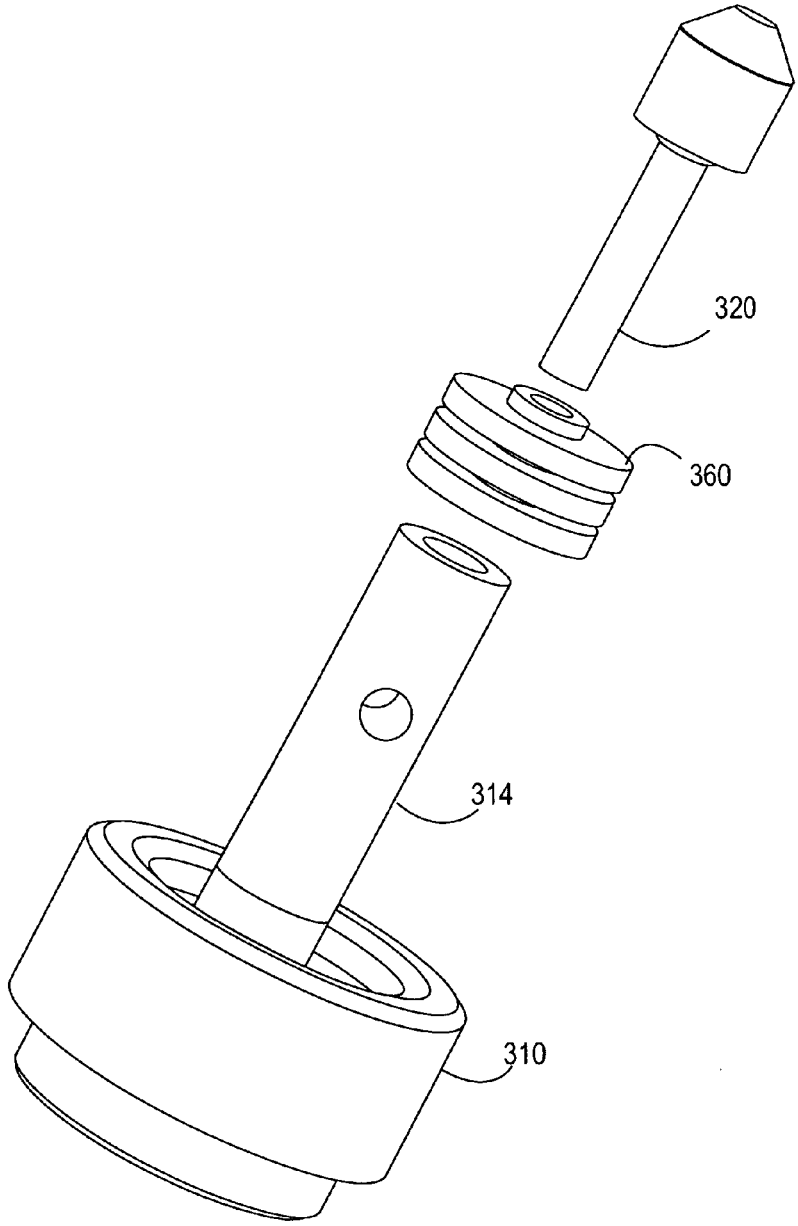
FIG. 3 shows an embodiment of an anode assembly.

FIG. 3 shows an embodiment of a top and anode assembly of a sub-miniature arc lamp. The assembly includes an anode 320, a number of mercury dispensing getters 360, a tubulation 314, and a top 310. The components in FIG. 3 are shown separated from each other in order to provide the reader with an unobstructed view of each component. In practice, the getters 360 are mounted along the anode 320 and the lower end of the anode 320 is inserted into the tubulation 314, which is attached to the top 310. In one embodiment, the anode 320 is press fitted into the top 310.

Figure 4:
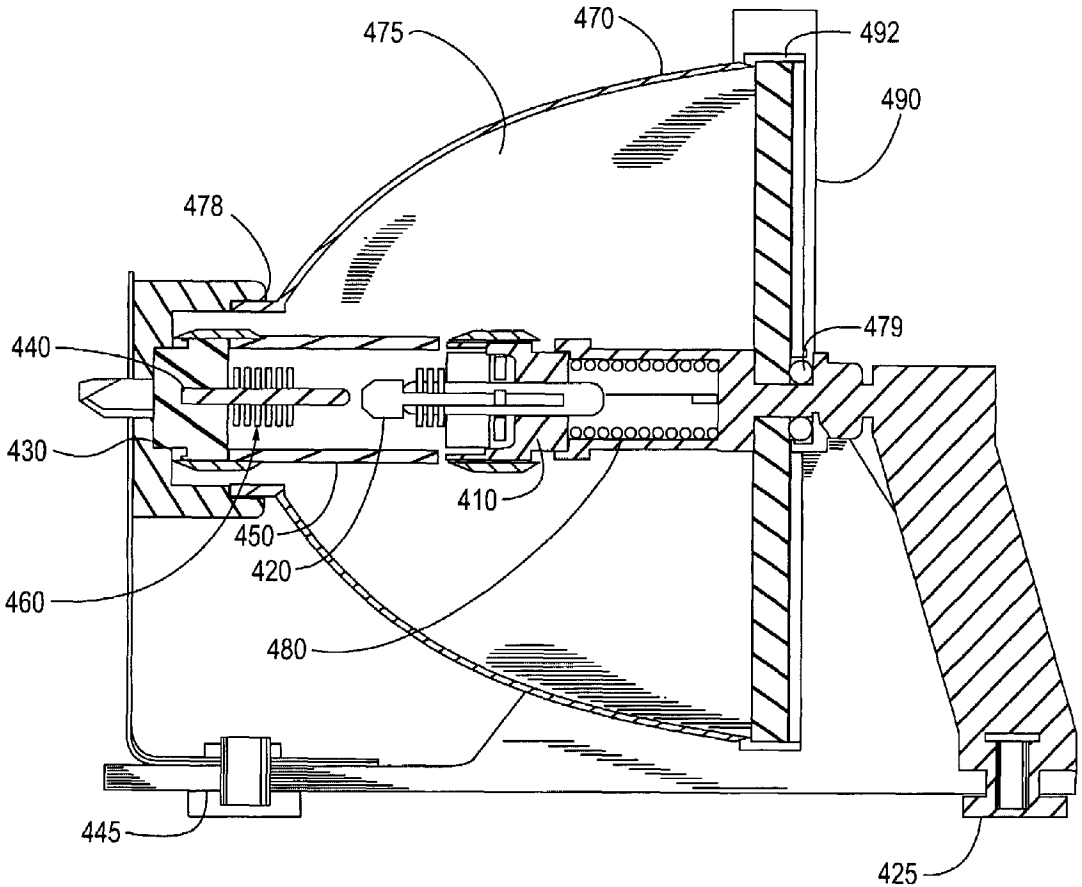
FIG. 4 shows an alternate embodiment of a sub-miniature arc lamp.

FIG. 4 shows a cross-section view of an embodiment of a sub-miniature arc lamp. The embodiment includes a top 410, an anode 420, a base 430, a cathode 440, a sapphire tube 450, and a number of getters 460, an airtight housing 470, a seal 478, a spring 480, a glass window 490, an "O" ring seal 479, a window seal 492, a cathode socket connection 445, and an anode socket connection 425. The anode 420 is mounted in the top 410. The cathode 440 is mounted in the base 430. The top 410 and the base 430 are attached to the top and bottom of the sapphire tube 450 respectively to form a sealed envelope. The sealed envelope inside the sapphire tube 450 is filled with an inert gas. A number of getters 460 are mounted along the anode 420 and the cathode 440 to absorb or remove impurities inside the sapphire tube. In one embodiment, the getters include one or more mercury-dispensing getters.

The assembly of the sapphire tube 450, the top 410, and the base 430 is mounted inside the airtight housing 470, which has a bottom, a top, and a curved surface in between. The bottom of the housing is coupled to the base 430 at the seal 478. The bottom of the housing 470 is further coupled to a cathode socket connection 445. The top of the housing 470 is coupled to the glass window 490 and the junction between the window 490 and the housing 470 is sealed with the window seal 492. The top 410 is coupled to the glass window 490 via the "O" ring seal 479 and the spring 480. The top 410 is further coupled to an anode socket connection 425 through the glass window 490. The cavity 475 inside the housing 470 is filled with an inert gas. The inert gas surrounds the seal between the sapphire tube and the top and the one between the sapphire tube and the bottom. In one embodiment, the housing 470 is filled with argon. Surrounding the seals with inert gas prevents oxidation of the seals in order to prolong the lamp life. It is because oxidation weakens the seals and makes the seals more susceptible to leakage.

Figure 5:
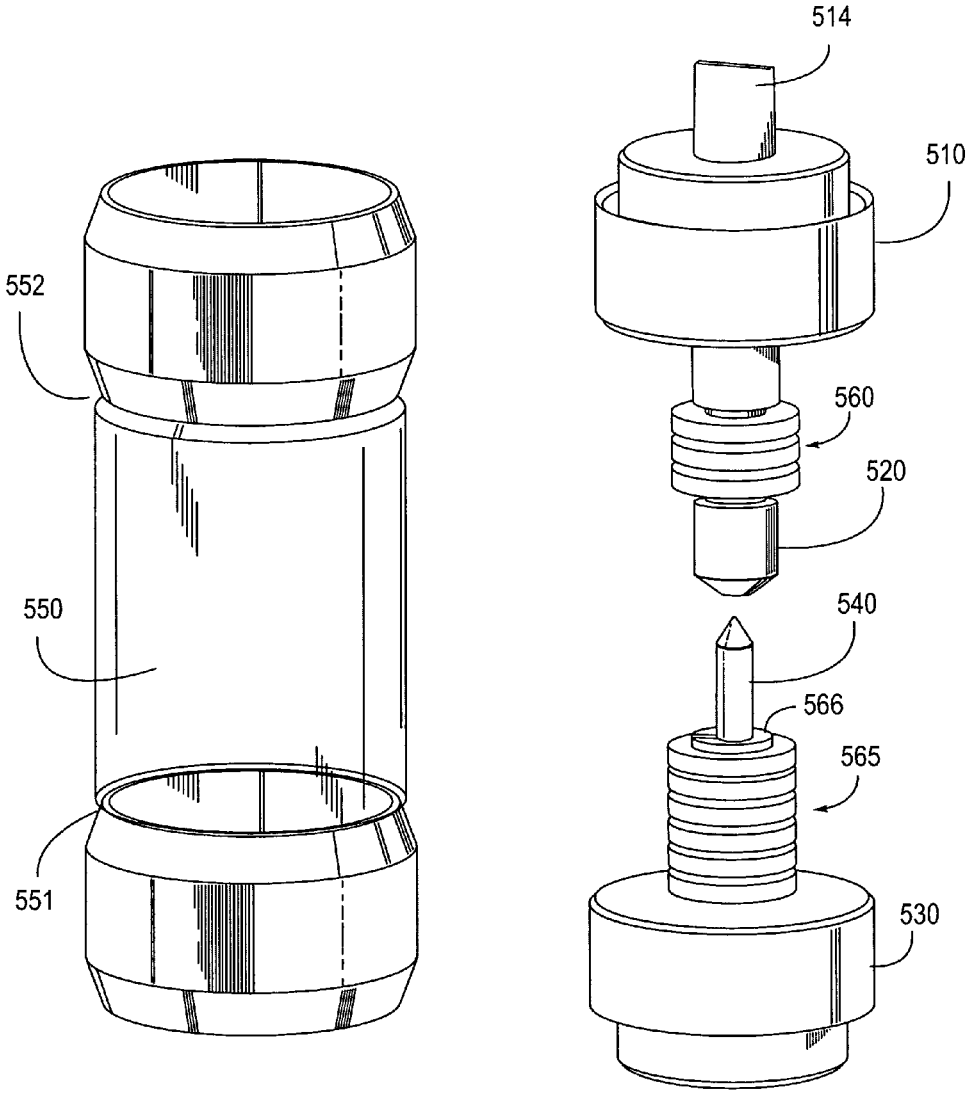
FIG. 5 shows an embodiment of a sub-miniature arc lamp.

FIG. 5 shows an embodiment of a sapphire body with sapphire to metal seals and an embodiment of the anode and cathode assemblies before being coupled to the sapphire body. On the left side of FIG. 5, a sapphire body 550 in the shape of a tube is coupled to a sapphire-to-metal seal 551 at the bottom of the tube and another sapphire-to-metal seal 552 at the top of the tube. On the right side of FIG. 5, a tubulation 514 is inserted and brazed into a top 510 to accommodate an anode 520 mounted in the top 510. A number of getters 560 are mounted along the anode 520. In one embodiment, the getters 560 include one or more mercury-dispensing getters. The anode 520 is aligned with a cathode 540, which is mounted in a base 530. A second set of getters 565 are mounted along the cathode 540. A number of spacers 566 are mounted along the cathode 540, one between every two getters. The assembly of anode and cathode on the right side of FIG. 5 can be mounted to the top and bottom of the sapphire body 550 respectively to form a sealed envelope, which will be filled with an inert gas.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. A sub-miniature arc lamp comprising:

a sapphire body having a first end and a second end, the first end being coupled to a first cap and the second end being coupled to a second cap to define a sealed envelope;

a first electrode comprising a first rod having a first end and a second end, the first end being mounted in the first cap, the first electrode further defining a ridge near the second end;

a second electrode comprising a second rod having a first end and a second end, the first end of the second rod being mounted in the second cap;

a first set of one or more getters, each of the one or more getters comprising a disc having a cavity defined substantially at a center of the disc and the first rod of the first electrode passing through the cavity such that the getter is mounted on the first rod between the first and the second ends of the first rod; and a retainer ring mounted at the ridge near the second end of the first electrode to hold the one or more getters in place.

2. The sub-miniature arc lamp of claim 1, wherein the first set of one or more getters includes one or more mercury-dispensing getters.

3. The sub-miniature arc lamp of claim 1, further comprising a second set of one or more getters being mounted along the second electrode, each of the one or more getters comprising a disc having a cavity defined substantially at a center of the disc and the second rod of the second electrode passing through the cavity such that the getter is mounted on the second rod between the first and the second ends of the second rod.

4. The sub-miniature arc lamp of claim 3, wherein the second set of one or more getters include one or more mercury-dispensing getters.

5. The sub-miniature arc lamp of claim 1, further comprising an airtight housing substantially surrounding the sapphire body.

6. The sub-miniature arc lamp of claim 5, wherein the airtight housing contains an inert gas.

7. The sub-miniature arc lamp of claim 1, wherein the sapphire body is a sapphire tube.

8. The sub-miniature arc lamp of claim 1, wherein the first electrode is a cathode and the second electrode is an anode.

9. A sub-miniature arc lamp comprising:

a sapphire body having a first end and a second end, the first end being coupled to a first cap and the second end being coupled to a second cap to define a sealed envelope, wherein the sapphire body is substantially surrounded by an airtight housing filled with an inert gas;

a first electrode comprising a first rod having a first end and a second end, the first end being mounted in the first cap and the second end remains substantially freestanding, the first electrode further defining a ridge near the second end;

a second electrode comprising a second rod having a first end and a second end, the first end of the second electrode being mounted in the second cap and the second end of the second rod remains substantially freestanding;

one or more getters being mounted along the first electrode, each of the one or more getters comprising a disc having a cavity defined substantially at a center of the disc; and a retainer ring mounted at the ridge near the second end of the first electrode to hold the one or more getters in place.

10. The sub-miniature arc lamp of claim 9, wherein the one or more getters include one or more mercury-dispensing getters.

11. The sub-miniature arc lamp of claim 9, further comprising one or more getters being mounted along the second electrode.

12. The sub-miniature arc lamp of claim 11, wherein the one or more getters include one or more mercury-dispensing getters.

13. The sub-miniature arc lamp of claim 9, wherein the sapphire body is a sapphire tube.

14. A sub-miniature arc lamp comprising:

an airtight housing having a first end and a second end, the airtight housing filled with a first inert gas;

a seal coupled to the second end of the airtight housing;

a glass window coupled to the first end of the airtight housing via a window seal, the glass window defining an opening substantially at a center of the glass window;

an anode socket connection coupled to the glass window through the opening, the anode socket connection including a cylindrical portion housed within the housing, the cylindrical portion defining a cavity;

a spring housed within the cavity of the cylindrical portion of the anode socket;

a sapphire body having a top and a bottom, the sapphire body housed within the airtight housing, the sapphire body filled with a second inert gas, the bottom coupled to an inner side of the seal at the second end of the airtight housing, and the top coupled to an open end of the cylindrical portion of the anode socket connection and the spring;

a cathode mounted on the cathode end of the sapphire body;

an anode mounted on the anode end of the sapphire body; and a plurality of getters mounted on the cathode.

15. The sub-miniature arc lamp of claim 14, wherein the first inert gas is argon.

16. The sub-miniature arc lamp of claim 14, wherein the plurality of getters comprise mercury-dispensing getters.

* * * * *